US010876766B2

(12) United States Patent
Ng

(10) Patent No.: US 10,876,766 B2
(45) Date of Patent: Dec. 29, 2020

(54) GAS HEATER FOR WATER AND A GAS WATER HEATER

(71) Applicant: Rheem Australia Pty Limited, Rydalmere (AU)

(72) Inventor: Wilson Ng, Sydney (AU)

(73) Assignee: Rheem Australia Pty Limited, Rydalmere (AU)

( * ) Notice: Subject to any disclaimer, the term of this patent is extended or adjusted under 35 U.S.C. 154(b) by 749 days.

(21) Appl. No.: 15/324,626

(22) PCT Filed: May 27, 2015

(86) PCT No.: PCT/AU2015/050279

§ 371 (c)(1),
(2) Date: Jan. 6, 2017

(87) PCT Pub. No.: WO2016/008001

PCT Pub. Date: Jan. 21, 2016

(65) Prior Publication Data

US 2017/0205115 A1 Jul. 20, 2017

(30) Foreign Application Priority Data

Jul. 15, 2014 (AU) ..... 2014902723
Feb. 20, 2015 (AU) ..... 2015900582

(51) Int. Cl.
*F24H 9/20* (2006.01)
*F24H 1/14* (2006.01)
(Continued)

(52) U.S. Cl.
CPC ..... *F24H 9/2035* (2013.01); *F23N 1/00* (2013.01); *F24D 19/1051* (2013.01);
(Continued)

(58) Field of Classification Search
CPC ..... F24H 9/2035; F24H 1/145; F23N 1/00; F24D 19/1051; F24D 2220/044; F24D 2220/042
(Continued)

(56) References Cited

U.S. PATENT DOCUMENTS

2008/0006710 A1 1/2008 Gabanyi et al.
2010/0116222 A1* 5/2010 Tsuji ..... F23N 1/082 122/14.2
(Continued)

FOREIGN PATENT DOCUMENTS

GB 1138228 A 12/1968
GB 2515768 1/2015

OTHER PUBLICATIONS

Canadian Office Action for corresponding Canadian application No. 2955032, dated Feb. 27, 2018.
(Continued)

*Primary Examiner* — Steven B McAllister
*Assistant Examiner* — Benjamin W Johnson
(74) *Attorney, Agent, or Firm* — Troutman Pepper Hamilton Sanders LLP

(57) ABSTRACT

The present invention provides a method of operating a gas heater for water including the steps of: restricting a water flow to the gas heater; determining a first rate of a first gas heating for the restricted water flow; adjusting the gas heating to the restricted water flow; repeating the previous steps until a heated water has a temperature above a temperature threshold; removing the restriction to the water flow to increase the water flow; and determining a second rate of a second gas heating for the increased water flow. The present invention also provides a gas water heater which utilises such a method.

4 Claims, 10 Drawing Sheets

(51) Int. Cl.
*F24D 19/10* (2006.01)
*F23N 1/00* (2006.01)

(52) U.S. Cl.
CPC ..... *F24H 1/145* (2013.01); *F24D 2220/042* (2013.01); *F24D 2220/044* (2013.01)

(58) Field of Classification Search
USPC ..... 122/14.21
See application file for complete search history.

(56) References Cited

U.S. PATENT DOCUMENTS

| | | | | |
|---|---|---|---|---|
| 2011/0284646 | A1* | 11/2011 | Furlong | F16K 31/002 236/93 R |
| 2012/0012198 | A1* | 1/2012 | Schneider | E03B 1/048 137/468 |
| 2012/0090560 | A1* | 4/2012 | Iwama | F24H 1/145 122/14.3 |

OTHER PUBLICATIONS

Canadian Office Action for corresponding Canadian application No. 2955032, dated Dec. 27, 2018.
International Search Report and Written Opinion dated Sep. 7, 2015 for PCT/AU2015/050279.

* cited by examiner

GAS HEATER FOR WATER AND A GAS WATER HEATER

CROSS REFERENCE TO RELATED APPLICATIONS

This application is a National Stage Entry of, and claims priority to, PCT Patent Application No. PCT/AU2015/050279 which was filed on 27 May 2015, which claims priority to and the benefit of Australian Patent Application No. 2015900582, which was filed on 20 Feb. 2015, and Australian Patent Application No. 2014902723, which was filed on 15 Jul. 2014. The entire contents and substance of the aforementioned applications are hereby incorporated by reference in their entireties as if fully set forth herein.

FIELD OF THE INVENTION

The present invention relates to a gas heater system, in particular to gas heaters for producing hot water. The invention also relates to instantaneous gas hot water systems suitable for producing hot potable water. The invention also relates to natural aspiration instantaneous gas water heaters as well as those with a motorised gas flow control valve.

BACKGROUND OF THE INVENTION

There are various known apparatus and systems for gas hot water systems as well as methods of operating gas hot water systems. There are also gas heater systems for water which are termed "instantaneous" to denote that the water is directly heated on demand. That is the water is not heated earlier and then stored in a tank for later use.

There are also natural draught gas water heaters where air for combustion by the gas burner is supplied by a natural aspiration or draught. That is, no fan associated with the combustion chamber.

None of these prior art apparatus, systems and methods provides an entirely satisfactory solution to rapidly producing hot, potable water with a minimum of hot water delivery lag time. Nor to minimising energy consumption when providing the hot water.

Any reference herein to known prior art does not, unless the contrary indication appears, constitute an admission that such prior art is commonly known by those skilled in the art to which the invention relates, at the priority date of this application.

SUMMARY OF THE INVENTION

The present invention aims to provide an alternative arrangement and method gas heater for water which overcomes or ameliorates the disadvantages of the prior art, or at least provides a useful choice.

In one form, the invention provides a method of operating a gas heater for water including the steps of: restricting a water flow to the gas heater; determining a first rate of a first gas heating for the restricted water flow; adjusting the gas heating to the restricted water flow; repeating the previous steps until a heated water has a temperature above a temperature threshold; removing the restriction to the water flow to increase the water flow; and determining a second rate of a second gas heating for the increased water flow.

The step of removing of the restriction to the water flow includes electronically controlling a by-pass valve to the water flow to the gas heater.

The step of removing of the restriction to the water flow includes using a temperature dependent shape memory alloy to actuate a by-pass valve to the water flow to the gas heater.

The method further including the step of opening the by-pass valve to increase the water flow.

The method further including the step of: setting at least one temperature threshold according to a by-pass valve operating characteristic.

The step of determining a first rate of a first gas heating rate includes at least one of a T-outlet temperature sensed value, a pre-heat time, a water flow rate, a flame on signal, a valve operating characteristic and a T-inlet temperature value.

The method, whereby a hot water delivery lag time is reduced by at least approximately 50%.

In further form, the invention provides a gas heater for water comprising: a heat exchanger heated by a gas burner; a water inlet and a water outlet to the heat exchanger; and a water control flow restriction means to at least one of the water inlet and the water outlet; wherein the water control flow restriction means increases the water flow to the heat exchanger when a water temperature from the water outlet is greater than a first temperature threshold.

The water flow restriction means comprises: a water flow restricted or constricted path; and a water by-pass path; wherein the water by-pass path is opened to increase the water flow when a water temperature from the water outlet is greater than a first temperature threshold.

The water by-pass path includes an electronically controlling a by-pass valve or a temperature dependent shape memory alloy actuated by-pass valve.

The gas heater is an instantaneous gas heater of water.

The gas heater is a natural aspiration gas heater.

The present invention also provides a gas water heater having a gas heater operated by the method described in any one of paragraphs [006] to [013].

The present invention further provides a gas water heater having a gas heater as described in paragraphs [014] to [018].

The gas water heater described above can be an instantaneous gas water heater.

The gas water heater described above can alternatively be a natural aspiration gas water heater.

In an alternate form the invention provides a method of operating a gas heater for water substantially as described herein with respect to FIGS. 3*a*, 3*b*, 4 and 5.

In yet another alternate form the invention provides a gas heater for water substantially as described herein with respect to FIGS. 1*a*, 1*b*, 1*c*, 1*d*, 2*a* and 2*b*.

In another form the invention provides a water flow restriction means including: a water flow restricted or constricted path; and a water by-pass path; wherein the water by-pass path is opened to increase the water flow when a water temperature from the water outlet is greater than a first temperature threshold.

In further form, the invention provides a method of operating a gas heater for water including the steps of: a pre-heat operational mode; reducing a water flow in the pre-heat mode; sensing a heated water temperature in the pre-heat mode; increasing the water flow when the heated water temperature is sufficient; and a normal heating operational mode.

Further forms of the invention are as set out in the appended claims and as apparent from the description.

BRIEF DESCRIPTION OF THE DRAWINGS

A detailed description of a preferred embodiment will follow, by way of example only, with reference to the accompanying figures of the drawings, in which:

In the figures the reference numerals are prefixed by the figure number. For example FIG. 1 is the "100" series, FIG. 2 is the "200" series and so on.

DETAILED DESCRIPTION OF THE EMBODIMENT OR EMBODIMENTS

Traditional instantaneous gas water heaters which utilise a water pressure differential diaphragm mechanism to control gas valve opening are lacking in controlling of hot water temperature at initial starting. Newer motorised gas volume flow control valves can have a long reaction time for the motorised gas valve to adjust its operating position, thus such water heaters may start smoothly but it takes longer for the hot water temperature to reach the desired set point temperature.

Both traditional instantaneous gas water heaters and the later motorised gas valve technologies often do not require any external electrical mains power to operate. This is an attractive feature to users where an installation of additional power point or other electrical supply is costly or impractical. Alternatively frequent interruption of electrical main power supply can result in unreliable hot water supply for gas heaters for water which are reliant on an external electrical supply.

In adapting motorised gas volume flow control valve technology, the problem of its inherent slow start performance reduces the capability of fast hot water delivery and water saving. For a cool environment/season or a cold climate, users will experience longer waiting times for hot water. When tested to Australian standard AS4552, a motorised gas volume flow control water heater will yield a low energy star rating or a low energy efficiency rating for the appliance.

Currently fully electronically controlled instantaneous gas water heaters, which utilise mains electrical power or other external electricity source, use a stepping motor to control water flow volume through the water heater. Though the performance may be adequate, such electronic control gas heaters require considerable electrical power to compute external signals (input from various sensors associated with the gas heater) and to control the position of the stepping motor valve. This electrical power consumption may be too high for the traditional battery operated instantaneous gas water heaters to adopt.

To address this slow start behaviour to hot water delivery lag with the use of motorised gas valve technology in traditional instantaneous gas water heater, this invention provides a lower energy consumption means to control water flow at cold start-up of a gas heater for water.

An instantaneous gas water heater (hereafter termed "Water Heater(s)") may have water pipes, water flow control devices, a heat exchanger, sensors, ignition devices, gas flow control devices, a gas burner and an enclosure to accommodate these components.

Figure 1A:
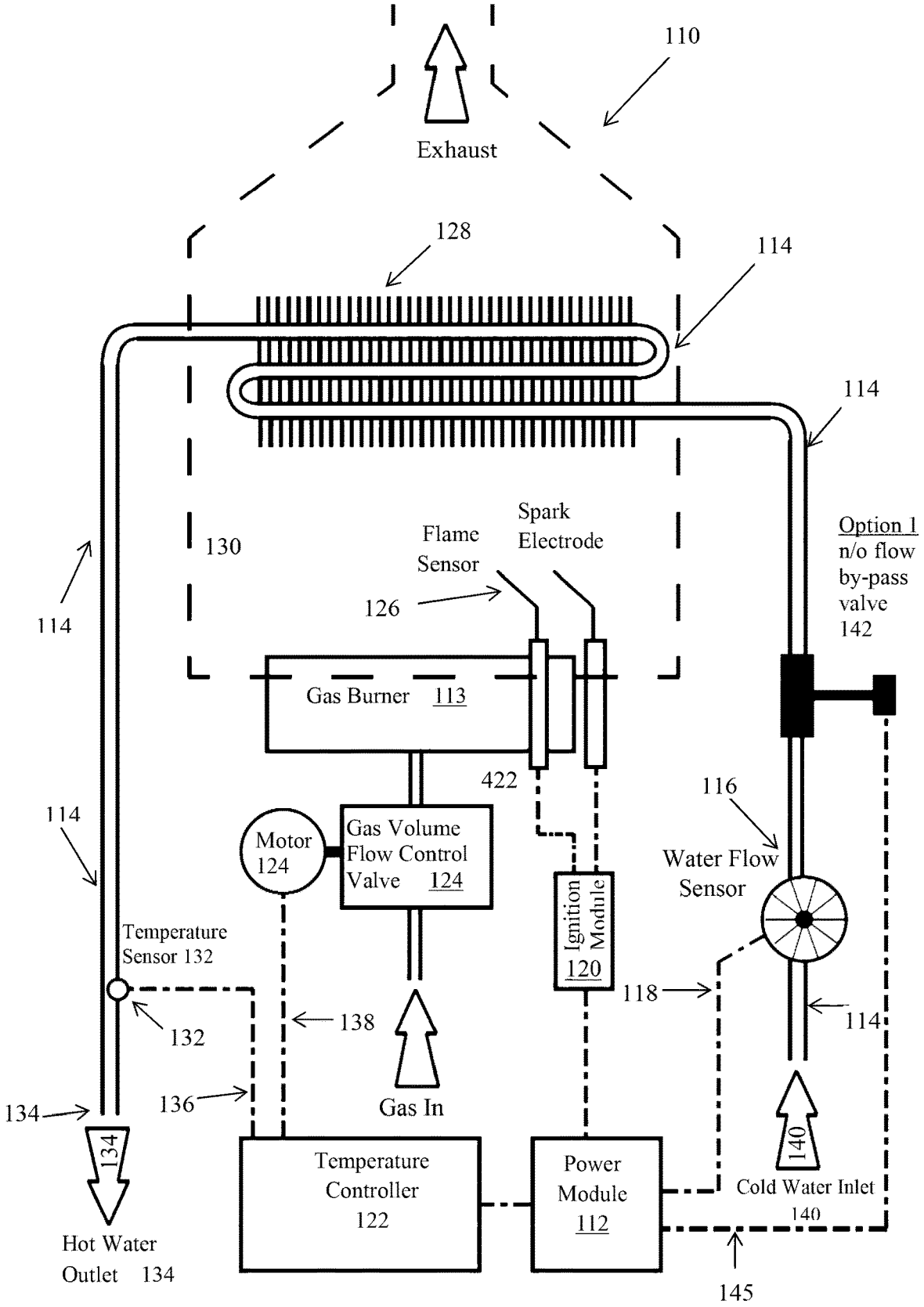
FIG. 1*a* is a schematic of a gas heater for water with an electronically controlled by-pass valve.

The water heater 110 shown in FIG. 1*a* may not utilise any external mains electrical power (240Vac and/or 110Vac for example) for its operation. In FIG. 1*a*, the power module 112 which is contained by the cabinet of the water heater can be either or a combination of dry cell batteries, a rechargeable battery system, water turbine electrical power generator, solar array, a Peltier electric generator element (using the gas burner as the hot source and the cold water inlet 140 as the cold source for example) or other suitable self-contained or internal electricity generating means.

When a water tap (not shown), downstream of the water heater 110 is turned on by a user, water flows through the water pipes 114 and the water flow sensing device 116 will generate a flow signal 118. In the preferred embodiment, the water flow sensor 116 is a hall-effect water flow turbine sensor. However, it can be a flow switch or some other mechanical means to activate a limit switch. Once a flow signal 118 is provided by the water flow sensor 116, the power module 112 will power an ignition module 120, a temperature controller 122 and a gas valve 124 to initiate a gas ignition cycle.

When a flame signal is provided via a flame sensor 126 or thermocouple (depending on the ignition system design), gas flow to the gas burner 113 will be maintained to heat up water that passes through the heat exchanger 128 in a natural draught combustion chamber 130.

The temperature of the hot water is monitored by a temperature sensor 132 near the exit of the hot water outlet 134. The temperature sensor 132 can be a NTC thermistor. A temperature signal 136 produced by the temperature sensor 132 is a feedback to the temperature controller 122. In the preferred embodiment, the temperature controller 122 is an electronic circuit with firmware which is designed to: accept power from the power module 112, to accept signals 118, 136 from the water flow sensor 116 and the temperature sensor 132; to condition these input signals, and then to output an electrical signal for gas flow 138 to control the position of the motorised gas volume flow control valve 124. The objective is to achieve a stable outlet hot water temperature at the hot water outlet 134 which matches a pre-set temperature at the temperature controller from start-up at a low fluid flow-rate to a higher fluid flow-rate after the start-up period or start-up/pre-heat operational mode.

Figure 1B:
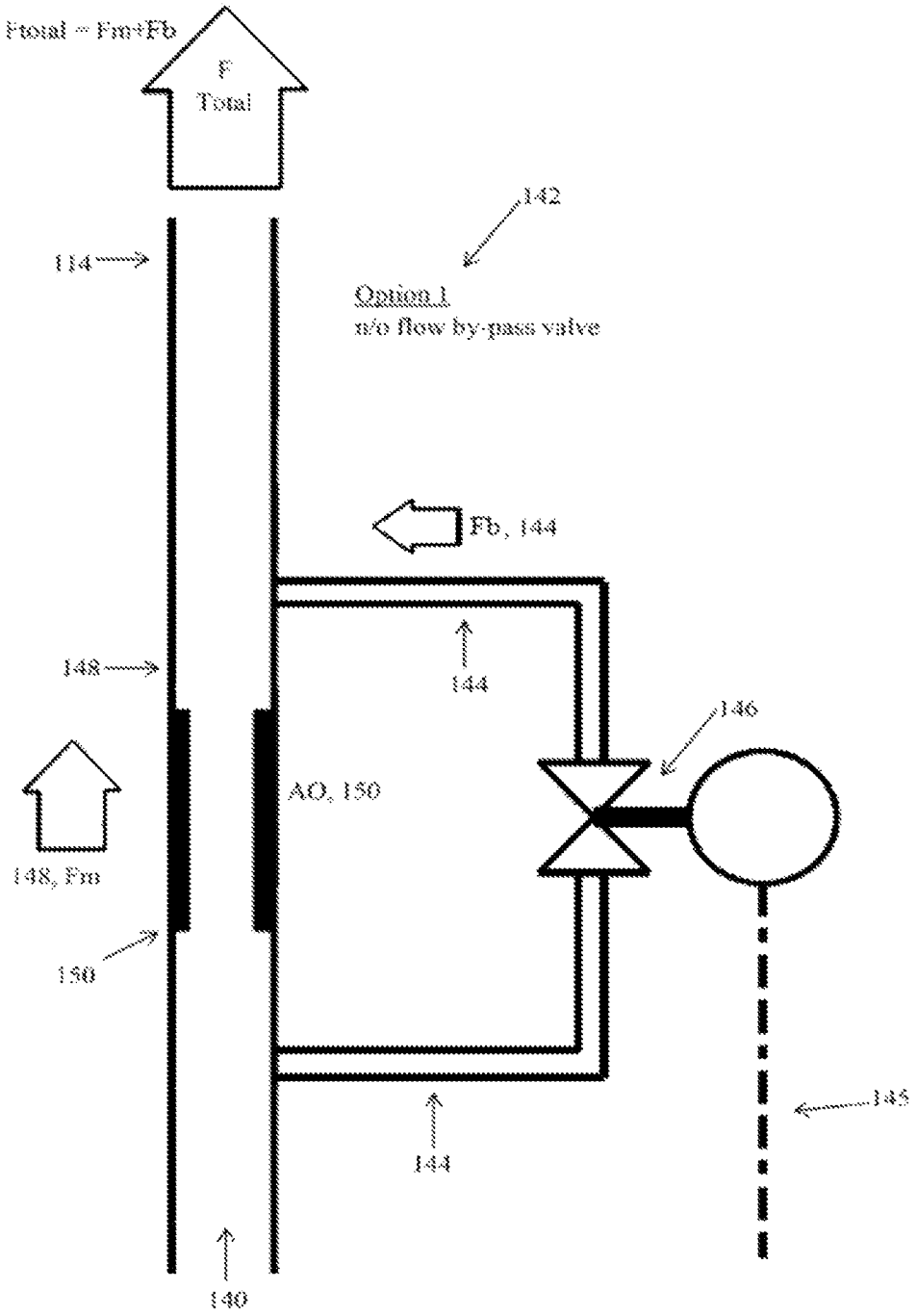
FIG. 1*b* is a schematic of an electrically controlled by-pass valve.
Figure 1C:
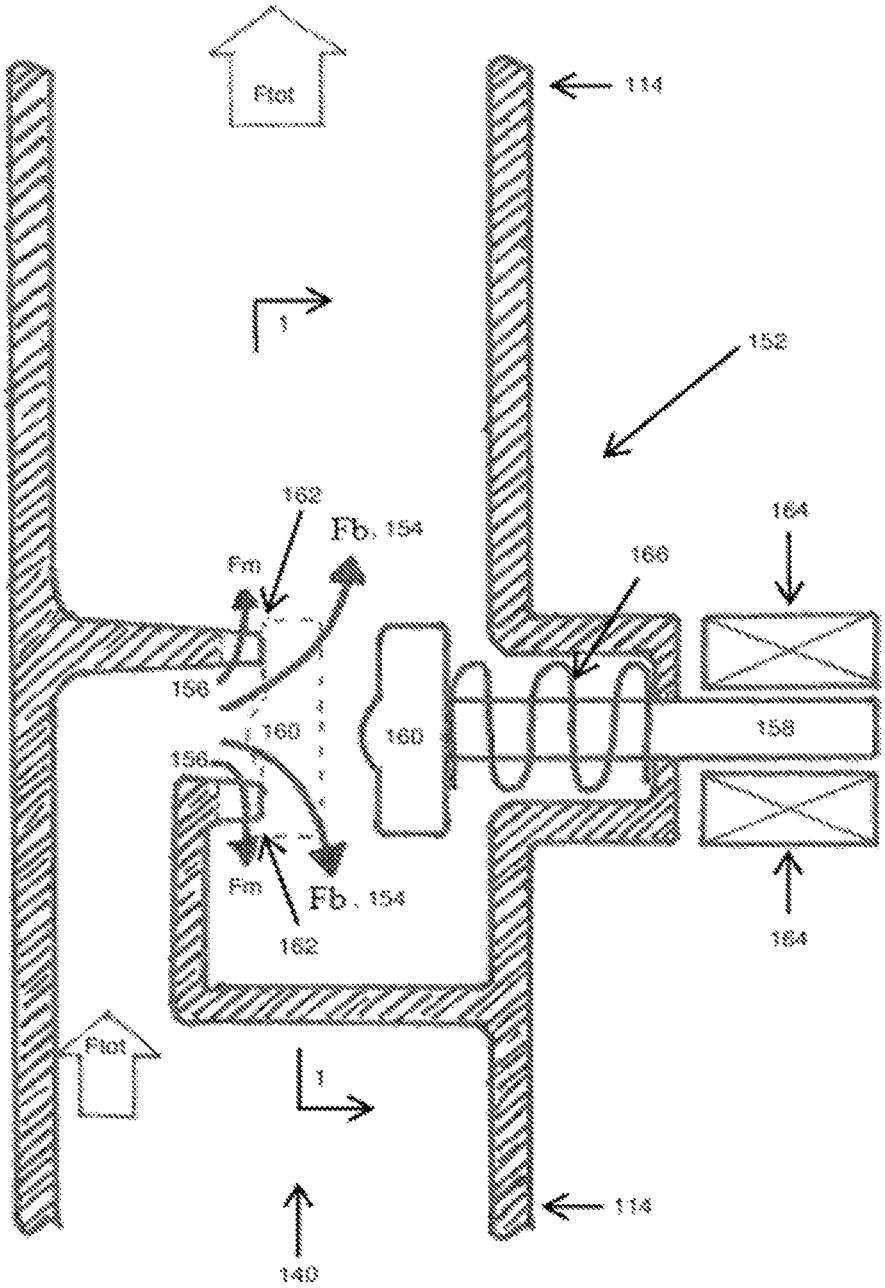
FIGS. 1*c* and 1*d* are schematics to cross-sectional views of an alternate electronic solenoid valve to that of FIGS. 1*a* and 1*b*.
Figure 1D:
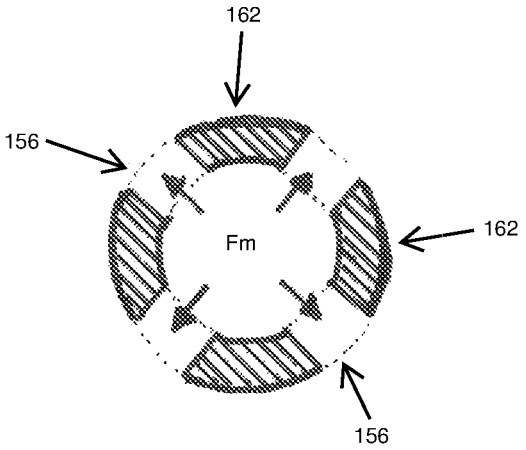
Figure 2A:
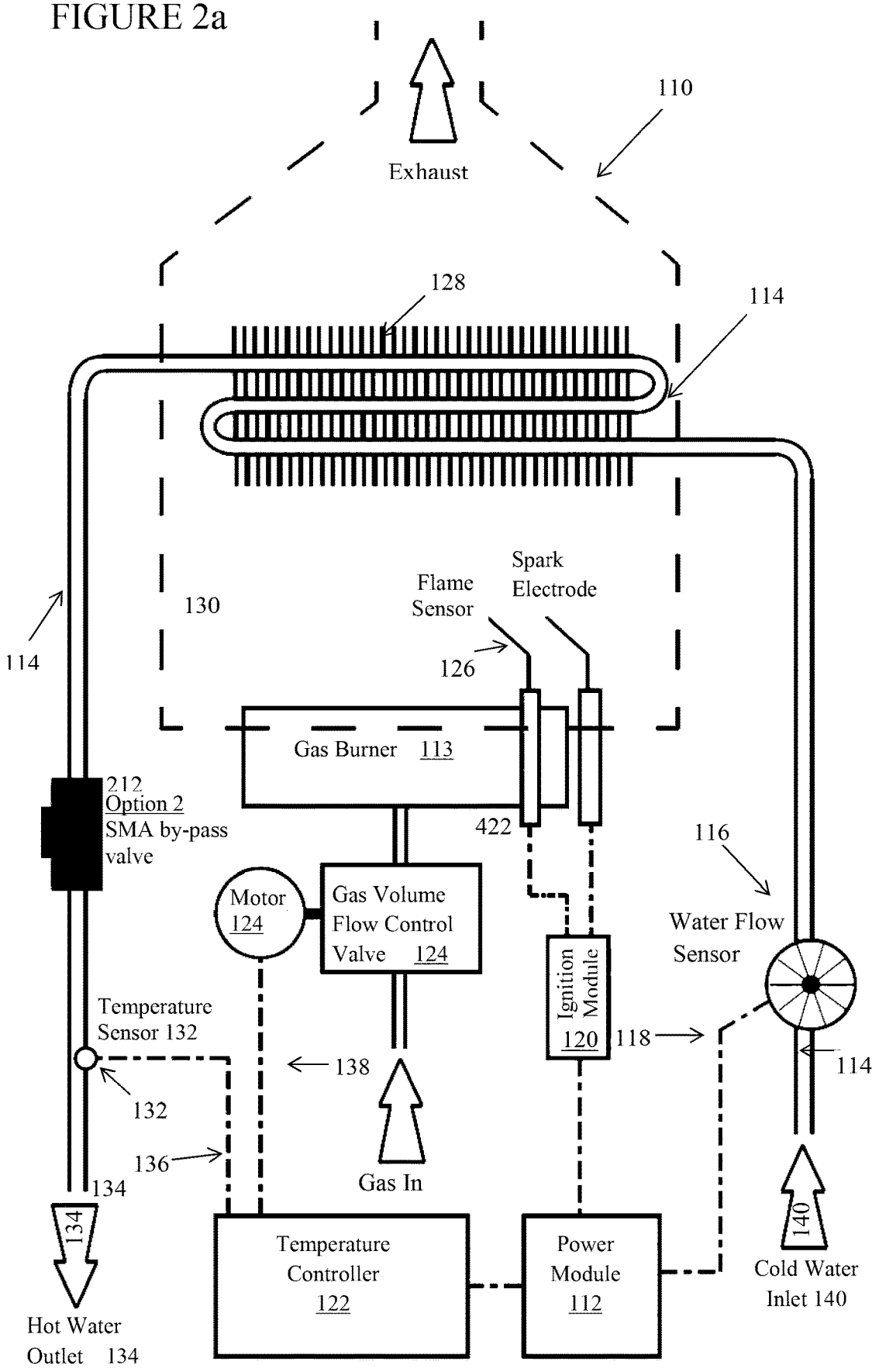
FIG. 2*a* is a schematic of a gas heater for water with a shape memory alloy mechanical water flow control device or valve.
Figure 2B:
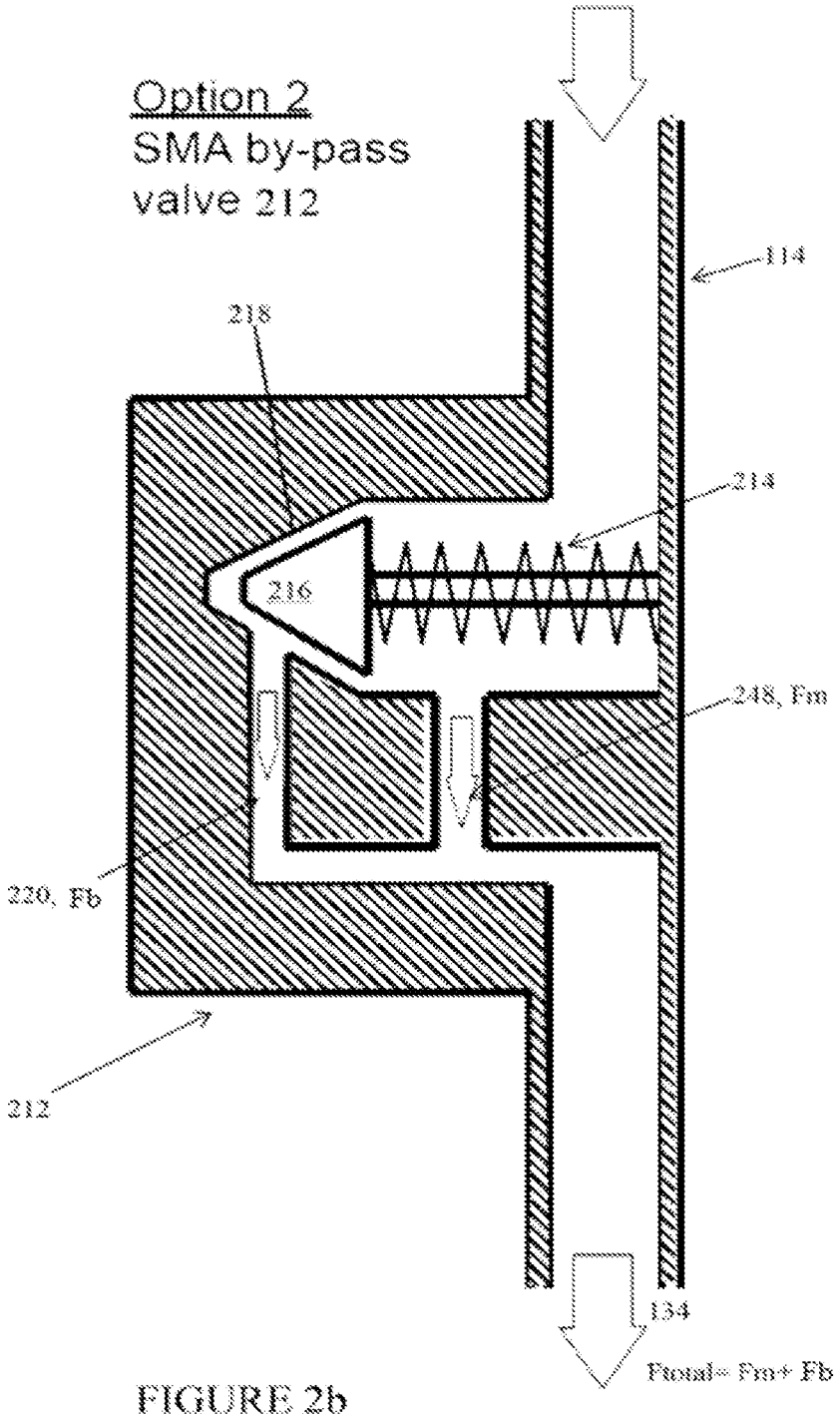
FIG. 2*b* is a schematic of a shape memory alloy mechanical water flow control device or valve.

The invention includes the methods and means to control water flow during the gas heater ignition process when the temperature (T-outlet) of the outlet 134 water is cool (below a 1st temperature threshold, T1). The methods and means to control water flow can be achieved by an electronic actuation and control means of the preferred embodiment shown in FIGS. 1*a*, 1*b*, 1*c* and 1*d* described in detail further below. An alternate embodiment to a mechanical means is shown in FIGS. 2*a* and 2*b*, as described in detail further below.

FIGS. 3*a* to 5 are flowcharts to the method of controlling and/or restricting water flow so as to reduce hot water delivery lag and improve "instantaneous" provision of hot water on demand. The flowcharts of FIGS. 3*a* to 5 schematically show the method used for the apparatus embodiments of FIGS. 1*a*, 1*b*, 1*c*, 1*d*, 2*a* and 2*b*. The process variables used in the flowcharts and detailed in the description below are listed as follows:

T-inlet: a temperature of the water at the cold water inlet 140;

T-outlet: a temperature of the water at the hot water outlet 134 as sensed by the temperature sensor 132 which provides a temperature signal 136;

Fm: a water flow rate through the main line 148, 156, 248 or constricted/restricted path of the valve or flow control device 142, 152, 212, in FIGS. 1*b*, 1*c*, 1*d* and 2*b* when a water tap is turned on;

Fb: a water flow rate through either of the respective by-pass paths 144, 154, 220 of either of the by-pass valves 142, 152, 212 of FIGS. 1*b*, 1*c*, 1*d* and 2*b*;

Ftot: a water flow rate through the water pipes 114 and heat exchanger 128 of the gas heater;

$$Ftot=Fb+Fm;$$

T1: a first temperature threshold applied to T-outlet. Below this temperature T1 the by-pass paths 144, 154, 220 of the valves 142, 152, 212 are closed. Also below this temperature the gas heater operates in a pre-heat mode;

T2: a second temperature threshold applied to T-outlet. Above the T2 temperature the by-pass paths 144, 154, 220 are open for respective by-pass valves 142, 152, 212 and the gas heater operates in the normal temperature control mode; the setting of the T1 and T2 temperature thresholds is dependent on a particular valve type's operating characteristic. This is described in detail with respect to FIGS. 1*a* to 1*d* and FIGS. 2*a* and 2*b*. For example the shape memory alloy (SMA) valve 212 of FIG. 2*b* may begin opening as the temperature rises above T1 and be fully open at temperature T2; and T3: a temperature set point for the desired hot water temperature from the hot water outlet when the gas heater is operating in the normal temperature control mode.

A Preferred Apparatus Embodiment—Electronically Controlled Water Flow By-Pass Valve 142:

FIG. 1*a* depicts a water by-pass valve 142 in the inlet water flow path to the heat exchanger 128. FIG. 1*b* shows an enlarged and more detailed schematic of the water by-pass valve 142. The control of water flow (Fb) through the by-pass path 144 is achieved by activating via a valve signal line 145 a solenoid valve 146. As shown in FIGS. 1*a* and 1*b*, this water by-pass valve 142 is located near the cold water inlet 140 of the water heater 110. However, the valve 142 can be located along any convenient point of the water flow path of the fluid pipes 114; for example near the hot water outlet 134, along the fluid pipes 114 to and from the heat exchanger 128 or can be integrated with the housing of the temperature sensor 132.

When a water tap is turned on by the user which is sufficient enough to be detected by the water flow sensor 116, an ignition sequence will start. A flow rate "Fm" through the main line 148 of the valve 142 is provided by a constriction 150 in the main line 148 when the water tap is turned on. The constriction 150 and cross-sectional area "A0" of the main line 148 of the valve 142 is described further below.

At substantially the same time as when the water tap being turned on is sensed the water temperature T-outlet detected by the temperature sensor 132. It will be readily appreciated that an additional, optional temperature sensor can be installed at the cold water inlet 140 of the water heater to provide a further temperature signal from the inlet 140. The cold water inlet temperature, T-inlet, may be used to provide additional input to the determination or calculation of the gas heating rates as described in detail with respect to in FIGS. 4 and 5.

If the hot water outlet water temperature T-outlet (or cold water inlet temperature T-inlet, if fitted to the water heater) is lower than the first threshold temperature, T1, then a temperature controller 122 will command 145 the water bypass valve 142 to shut off water flow going through a by-pass path 144, thus Fb≈0 L/min (where Fb is the flow rate through the by-pass path 144 shown in the valve of FIG. 1*b*). The by-pass path 144 may also be described as a secondary water flow path and a method of restricting the water flow. By shutting off part of the water flow path of by-pass path 144, it results in a higher water flow resistance in the water circuit 114. At the same inlet water pressure, the water flow rate will be reduced in the water circuit/water flow path 114 to the flow rate of Fm through only the main line 148 of the valve 142, that is Ftot=Fm.

Upon successful ignition of the main gas burner 113 and Fb remaining substantially zero in the water by-pass path 144, the water heater 110 operates in a pre-heat mode. With a reduced water flow rate of Fm only passing through the heat exchanger 128, the water in the heat exchanger gains heat faster at a given input gas rate, thus raising water temperature quicker. The heated water at the hot water outlet 134 is measured by the temperature sensor 132 and which provides a signal 136 feedback for T-outlet to the temperature controller 122. The rate of heating in the pre-heat mode can be controlled by the gas input rate. The pre-heat mode method is described further with respect to the flowchart of FIG. 4. The method to the initial status of the by-pass path 144 is described further with respect to the flowchart of FIG. 3.

The pre-heat mode is maintained until hot water temperature T-outlet at the outlet 134 reaches a 2nd temperature threshold T2. T2 can be set between 32° C. to 40° C. and is dependent on the pre-set temperature point T3 and the thermal mass of the heat exchanger. When hot water temperature T-outlet is above the 2nd threshold temperature T2, the temperature controller 122 will command via valve activation signal line 145 the by-pass path 144 to re-open. The water heater 110 now operates in a normal temperature control mode so as to thermostatically control hot water temperature to its pre-set temperature point T3. The water flow rate through the gas heater is now Ftot=Fm+Fb, where Fb≠0. T2 can be the same as T3 but usually T2 is set at a lower temperature than T3. This is because in the pre-heat mode, the ratio of gas input rate to water flow volume is higher than the normal temperature control mode. That is, at pre-heat mode, depending on the construction and design of the heat exchanger 128, a full gas input to water flow rate ratio may be approximately doubled for example as compared to its normal input capacity for the normal temperature control method.

At the end of the pre-heat mode, a considerable amount of heat energy is stored in heat exchanger 128. By turning on the by-pass path 144 before hot water temperature reaches set point temperature T3, the extra volume of water flowing in the heat exchanger 128 can prevent overheating of the heat exchanger 128 and temperature overshoot at the hot water outlet 134.

Figure 5:
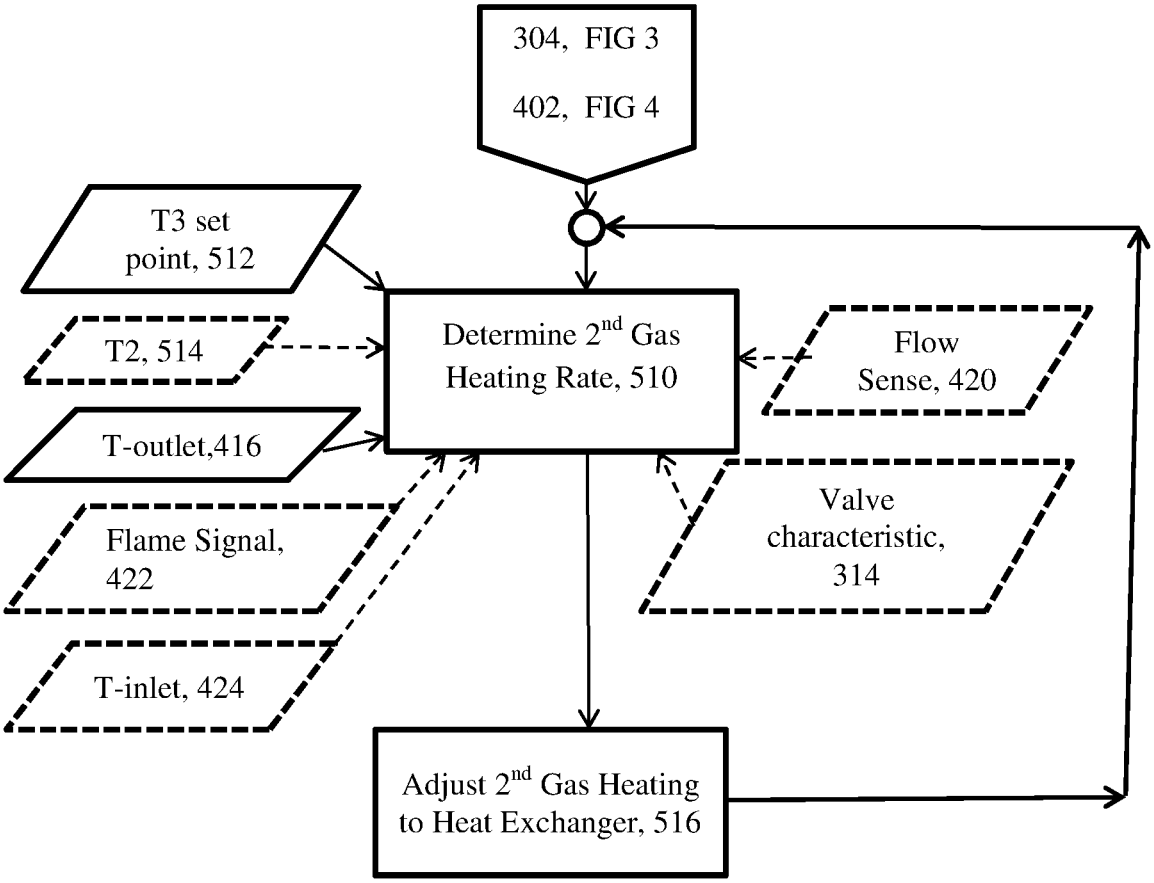
FIG. 5 is a flowchart schematic of a method to a normal temperature control mode.

The normal temperature control mode method is described further with respect to the flowchart of FIG. 5.

As described above and with respect to FIGS. 3*a* to 5, the method of controlling water flow during the pre-heat mode includes shutting off a water by-pass path 144. It will be readily appreciated that the water by-pass path does not necessarily have to be fully sealed or closed. A small leakage can still occur with satisfactory operation of the pre-heat mode.

In addition to or alternatively to controlling a by-pass path Fb: reduced water flow at pre-heat mode can be achieved by the constriction 150 of FIG. 1*b* controlling or further restricting a water flow cross-sectional area (A0) of the main line 148 through the valve 142. That is controlling the cross-sectional area A0 to Fm as shown in FIGS. 1*b*, 1*c* and 1*d* in addition to or as an alternative to the by-pass valve and path 144. Such fine tuning of the restriction area for the Fm flow-rate is also described further below with respect to FIGS. 1*c* and 1*d*.

When an operating water heater is turned off by closing a water tap downstream of the outlet 134, residual heat energy may maintain an elevated temperature of the water stored inside the water heater for a considerable time period; that is losses of heat to the ambient environment may be gradual. For example the exchanger 128 and gas burner 113 may stay hot for a period after water flow stops. As long as the water temperature measured at the temperature sensor 132 remains higher than the 1st temperature threshold T1, the bypass path 142 valve will remain open. The preheat mode will not be activated when the by-pass path valve is open and T-outlet≥T1. This is because the water heater may retain sufficient residual heat to achieve a fast heat up cycle with the normal temperature control mode method operating between temperatures T1 and T3.

It will be readily appreciated that the first temperature threshold T1 may be substantially the same as the second temperature threshold T2 for the electronically controlled valve 142, 152.

It will also be readily appreciated that for the electronically controlled valve 142, 152 the temperature threshold decision point settings are: when T-outlet<T1 then close bypass path 144, 154, otherwise the bypass path remains open. In pre-heat mode, the T2 temperature threshold is the point to re-open the bypass path 144, 154.

FIGS. 1*c* and 1*d* are schematics to cross-sectional views of an alternate electronic solenoid valve 152. FIG. 1*c* is a longitudinal cross-section through the water pipe 114 into and out of the alternate solenoid valve 152 and also a longitudinal cross-section through a valve spindle 158 of the alternate valve 152. The valve 152 is shown open with a valve plug 160 away from a valve seat 162. In dashed lines the valve plug 160" is shown in the closed position against the valve seat 162. The alternate solenoid valve 152 also has an electrically operated solenoid 164 which actuates the spindle 158 against the return spring 166 in order to open the valve 152 by pulling away the valve plug 160 from the valve seat 162.

Opening the valve 152 opens the bypass path 154 to provide the additional fluid flow rate Fb as shown in FIG. 1*c*, such that Ftot=Fb+Fm. The closed position of the alternate valve 152 with the valve plug 160 against the valve seat 162 closes the bypass path such that Fb≈0. In the closed position water may only flow through the valve 152 via the channels/restricted path 156 shown in FIG. 1*c*. Thus the total fluid flow rate Ftot=Fm only for the closed position or state of the alternate valve 152.

FIG. 1*d* is a cross sectional view along the lines 1-1 of FIG. 1*c* to show a plan view of the valve seat 162. The valve seat face has recessed channels 156 through which water may flow when the valve 152 is closed. Fm may be varied by varying the number of channels 156 and/or the cross-sectional of each channel/restriction 156 in the face of the valve seat 162. FIG. 1*d* shows four channels or restrictions 156.

An Alternate Apparatus Embodiment—SMA (Shape-Memory-Alloy) Mechanical Water Flow Control Device:

As an alternative to the electronic control means described with respect to of FIGS. 1*a* to 1*d*, a Shape Memory Alloy (SMA) flow control device 212 is installed near the hot water outlet 134 of the water heater or at any convenient point in the water flow path 114 downstream of the heat exchanger 128; where a water temperature change is appropriate to control the actions of the SMA valve 212. FIGS. 2*a* and 2*b* are schematics of the mechanical water flow control device 212 and the gas heater 210 for water.

The SMA valve 212 is designed in such a way that the SMA material 214 always sits in the main water flow path from the heat exchanger 128 and so directly detecting the temperature of the water as shown in FIG. 2*b*. The SMA material changes its physical property (shape or length for example) as a known function to temperature range. This temperature dependent characteristic is utilised to control the movement of valve 216 position in the valve seat 218. This temperature dependent characteristic of the SMA valve may also be termed a valve operating characteristic. As the water heater 210 is started from cold and then heated up, it then causes a reaction of the SMA material to adjust water flow with the valve.

At idle or cold start, the water temperature at the hot water outlet 134 may be substantially the same as that of the cold water inlet 140. The SMA operated by-pass path 220 will be shut off or closed at low ambient temperature threshold T1. When a water tap downstream of the water heater 210 is turned on, it starts with a reduced water flow volume or flow rate Fm because of the increased flow resistance from the constriction in the main line 248 of the mechanical flow control device 212. That is Ftot=Fm and Fb≈0 L/min.

Figure 4:
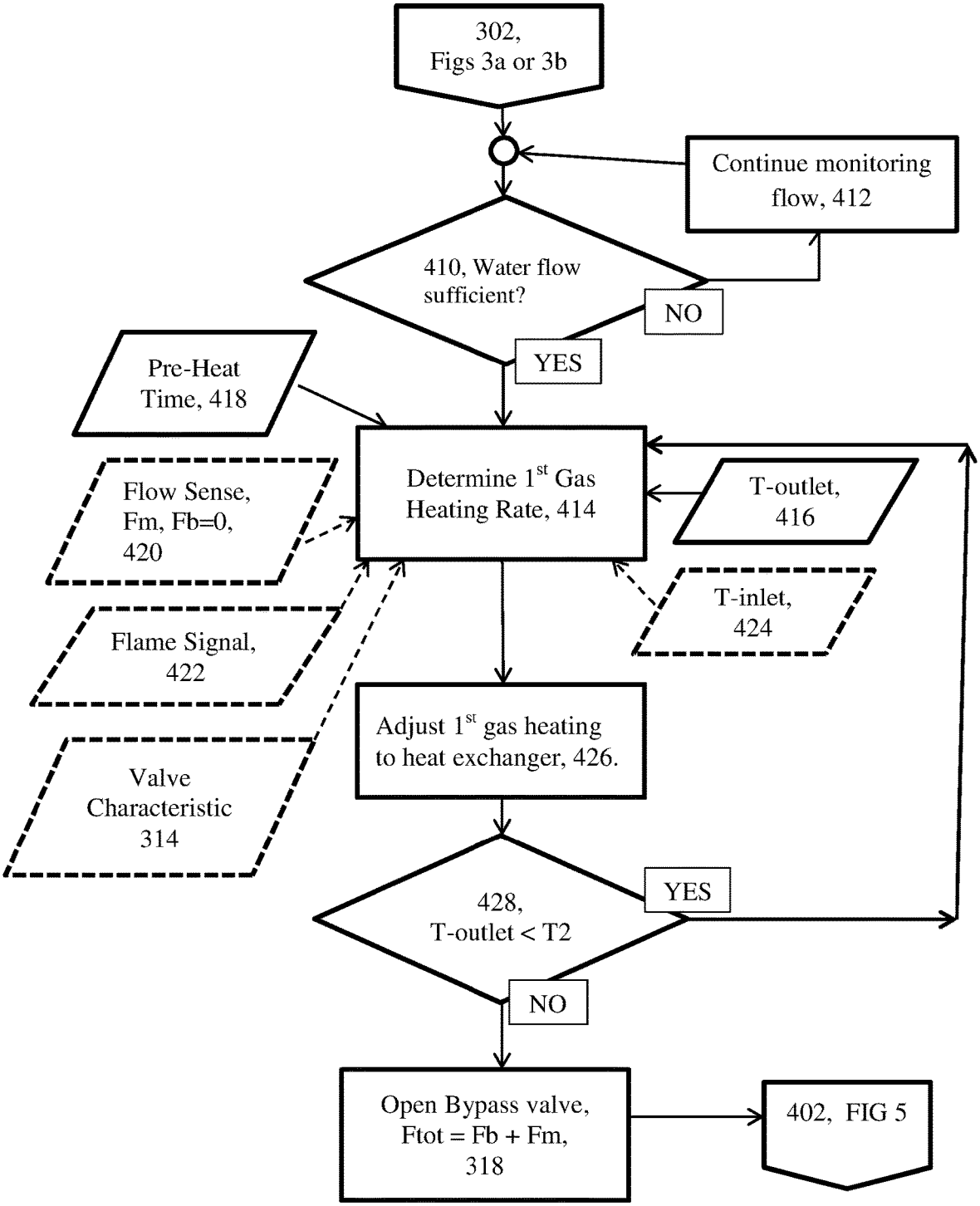
FIG. 4 is a flowchart schematic of a method to a pre-heat mode.

The water heater 210 then goes through ignition sequence and pre-heat mode as described earlier with respect to FIG. 1*a* and further with respect to the flowchart of FIG. 4.

Because of the thermal inertia of the SMA material 214, its reaction time to temperature changes may be considerably longer than the electronic system described with respect to preferred embodiment of FIGS. 1*a* to 1*d*. When the outlet temperature 134 T-outlet reaches the 2nd threshold T2 (in this case T2 may be set at a temperature lower than that in preferred embodiment, to compensate for the slower reaction/response time of the SMA valve), it relies on the SMA material 214 to react and slowly increase the flow to the by-pass path 220 in accordance with the SMA valve operating characteristic with fluid temperature. Gas input will be quickly reduced at this point T2 to compensate the reaction time in order to avoid overheating and temperature overshoot at the hot water outlet 134.

The operating characteristic SMA valve is accommodated for by the T1 threshold being the temperature below which the SMA valve is fully closed. The T2 threshold is the temperature above which the SMA valve is fully open. Between T1 and T2 the SMA valve is partially open. The pre-heat mode may still operate below and up to T2. The normal temperature control mode may operate from above T2 and including T3.

As the water temperature increases, the SMA by-pass path 220 will reach its fully open position so that Ftot=Fm+Fb, where Fb≠0. At the stage of the fully open position of the valve 216 & 218 the water heater 210 operates in a normal temperature and fluid flow rate control mode as also described with respect to the flowchart of FIG. 5.

When the water heater 210 is then turned off at the water tap downstream, the residual heat remaining in the system may allow the bypass path 220 to stay open if the water temperature about the SMA material is above the second temperature threshold T2. Therefore, there is no water flow throttling when the water heater is warm at above T2.

It will be readily appreciated that there is an art to the understanding of the desired characteristic and reaction time of the SMA material 214, and determination or selection of a 1st threshold temperature T1, the 2nd threshold temperature T2 and the set point temperature T3, dictates the control of gas input rate required in the pre-heat mode. That is the sensing and control by the temperature controller 122. Similarly it will also be readily be appreciated that there is an art to the understanding of the valve operating characteristic with respect to the SMA material used here in one valve in comparison to the valve operating characteristic of the electrically actuated valve of FIGS. 1*a* to 1*d*.

Alternatively instead of using a by-pass path, the SMA valve can be designed to solely control the opening of the main water flow path 114 (not shown). That is an alternative SMA valve (not shown) may operate between a partially open state and a fully open state for fluid flow control with no by-pass path 144. That is the alternative SMA valve only restricts the water flow within the gas heater fluid flow path.

Both the preferred embodiment and the alternate embodiment as described herein to this invention provides a means and a method to momentarily or temporarily reduce or restrict water flow rate during a cold start-up of a water heater with the pre-heat mode. The effect of adopting either of these methods or apparatuses reduces hot water delivery lag time, usually from approximately 25 seconds down to approximately 15 seconds. That is the hot water delivery lag time may be reduced by approximately 50%. In addition appreciably warm water can be delivered in the first approximately 5 to 15 seconds of the pre-heat mode. As a result, gas energy consumed to heat the initial volume of water at cold start to a set temperature is reduced. The energy usage may be maximised compare to similar water heaters without these devices and methods as described above.

The flowcharts of FIGS. 3*a*, 3*b*, 4 and 5 are described further as follows. The dashed lines in the flowcharts of FIGS. 3*a* to 5 indicate functions, features, inputs and the like which are optional.

Figure 3A:
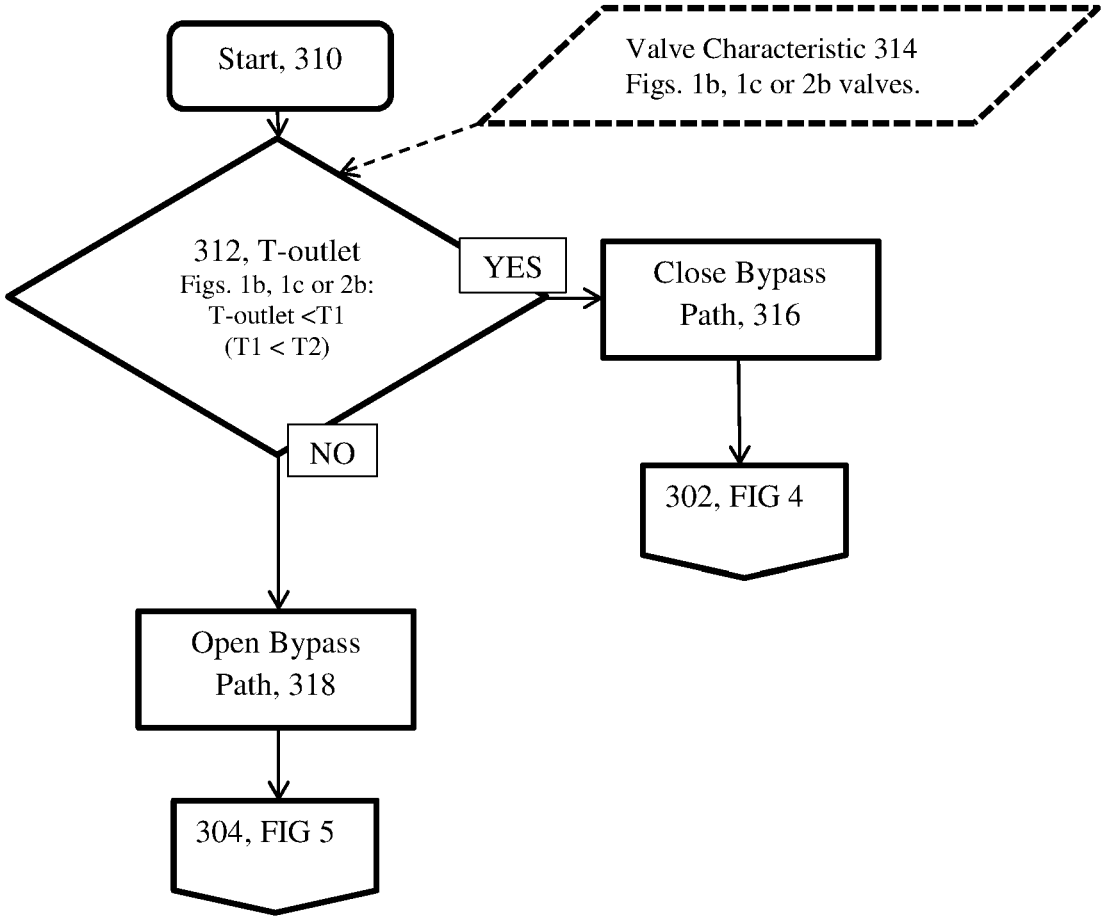
FIGS. 3*a* and 3*b* are flowchart schematics to methods for an initial status check of a by-pass path valve.

FIG. 3*a* is a flowchart schematic of a method to an initial status check of by-pass path 144, 220 for the electronic control by-pass valve 142 and the mechanical water flow control device 212. The by-pass valves 142, 212 of FIGS. 1*b* and 2*b* operate as normally open valves with respective fluid by-pass path 144, 220. The by-pass path opens and closes depending on the T-outlet temperature of the water for delivery to the hot water outlet 134 and the respective temperature thresholds T1 and T2 as well as the valve operating characteristics previously described. The opening of the by-pass path increases the water flow as described earlier in accordance with Ftotal=Fm+Fb.

The initial status check of the by-pass valve state may be started 310 either at tap turn on via the flow sensing for the electronically controlled by-pass valve 142 of FIGS. 1*a* to 1*d* or continuously for the SMA by-pass valve 212 of FIGS. 2*a* and 2*b*. T-outlet is then compared 312 against the T1 or T2 thresholds depending on the valve operating characteristic 314.

As described above the by-pass path is closed 316 if for an electronically controlled valve the T-outlet temperature is less than T1. If an SMA valve is used then the pass path is fully closed if T-outlet temperature is less than T1. The gas heater then proceeds 302 to the pre-heat mode method of FIG. 4.

If T-outlet temperature is above the T1 threshold applicable to a valve operating characteristic then the by-pass path may be opened 318 so that the water flow rate is Ftot=Fm+Fb, where Fb≠0. The gas heater may then proceed 304 to the normal control mode method of FIG. 5.

Figure 3B:
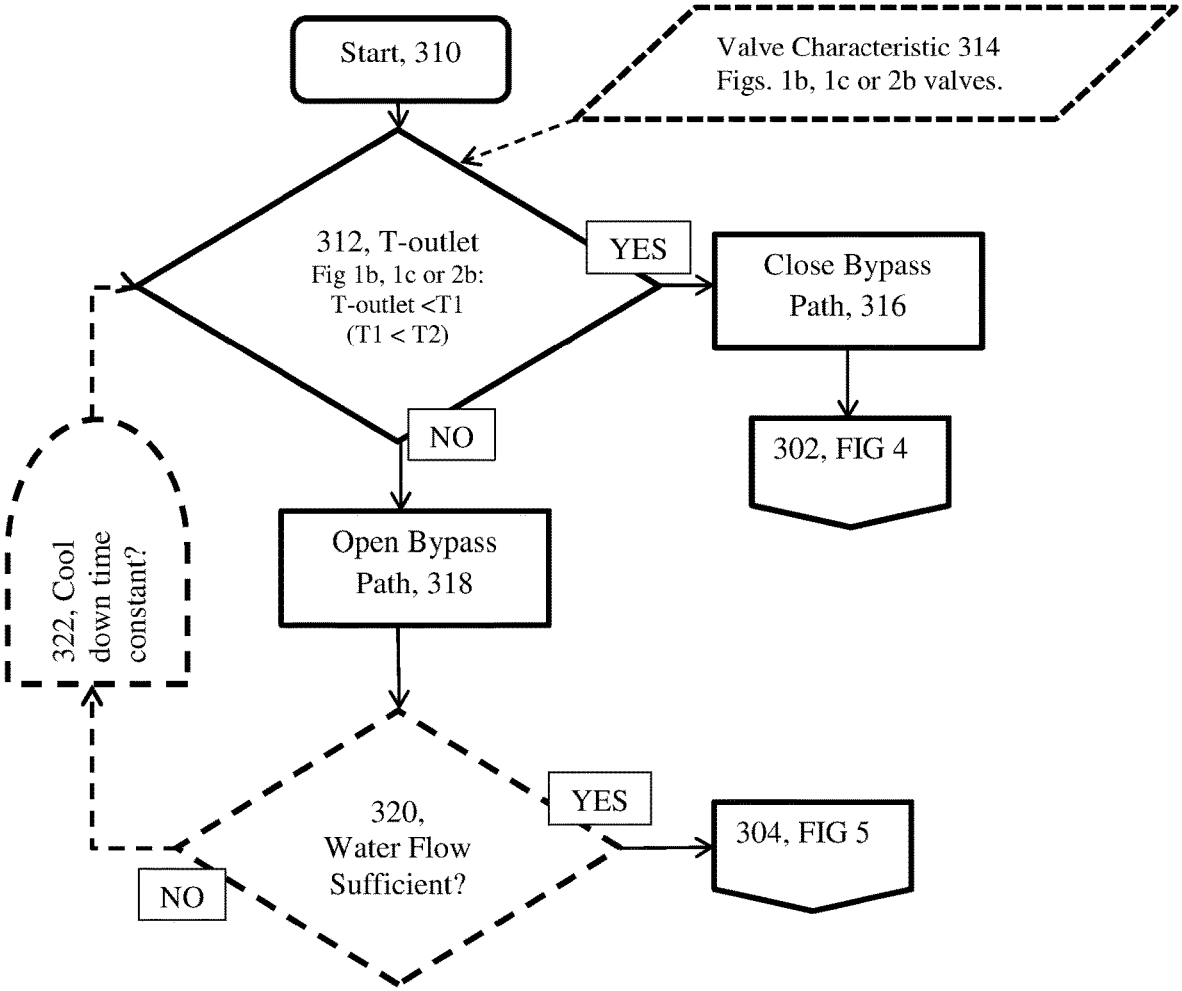

Optionally as shown in FIG. 3*b* the water flow may also be sensed 320 as sufficient for the normal temperature control mode method of FIG. 5. If for example a hot water tap is only turned on sufficiently open for satisfactory operation of the normal temperature control method then the water flow sensing of 320 may be unnecessary and omitted from the method as shown in FIG. 3*a*. However if the hot water tap may only be turned on partially which is insufficient for safe operation of the heat exchanger 128 then gas heater may not proceed to the normal temperature control method and may instead default to another safe operating mode version (not shown).

Also optionally the steps to sensing T-outlet 312 and opening the by-pass path 318 may be repeated if the gas heater is cooling down and there is insufficient water flow for normal operation as shown in FIG. 3*b*. The repetition may be delayed by a cool down time constant 322 which is characteristic of the gas heater and the valve operating characteristic. For example a gas heater with a larger thermal inertia will have a larger cool down time constant, so successive repeats may be delayed further.

FIG. 4 is a flowchart schematic of a method to a pre-heat mode as described above. The pre-heat method begins 302 from the by-pass being closed as described above and the methods of FIGS. 3*a* and 3*b*. The water flow rate is then sensed 410 as being sufficient, for example at the flow rate of Fm. If the flow rate is not sufficient then continuous monitoring 412 to when the flow rate is sufficient may be done. When the water flow rate is sufficient the gas heater may proceed to determining a first gas heating rate 414 for the gas burner to heat the heat exchanger 128. In determining the first gas heating rate of the heat exchanger, the T-outlet temperature sensed value 416 and the desired pre-heat time 418 may be used. The pre-heat time 418 may derived from the hot water delivery lag time for the invention and changed as suitable for a particular gas heater apparatus and the desired hot water delivery lag time. Other optional data values that may also be used to additionally determine the first gas heating rate 414 are: a water flow rate 420, a flame on signal 422, a valve operating characteristic 314 and a T-inlet temperature value 424.

The optional T-inlet sensed temperature at the cold water inlet 140 may be used to provide an additional temperature data input T-inlet 424 to determine the first gas heating rate 414 as applied by the gas volume flow control valve 124 and gas burner 113. For example in the winter season the temperature of the water from the cold water inlet 140 may be significantly cooler than the water supply temperature in the summer season. Accordingly the cooler water in the winter season will require more heating by the gas burner 113 to bring it to the desired or set temperature for the hot water at the hot water outlet 134 with minimal hot water delivery lag.

Once the gas heating rate has been determined 414 the gas heater may proceed to adjusting 426 a first gas heating to the heat exchanger. Then the gas heater may proceed to comparing 428 the T-outlet temperature to the second temperature threshold T2. If T-outlet is less than T2 then the gas heater remains in pre-heat mode with another determination 414 or continuous determination 414 of the necessary gas heating rate in pre-heat mode.

If the T-outlet is greater than T2 then the gas heater proceeds to opening 318 the by-pass valve and then proceeding 402 to the normal temperature control mode as described above and with respect to the flowchart of FIG. 5.

FIG. 5 is a flowchart schematic of a method to a normal temperature control mode as described above. The normal temperature control mode may be started from the pre-heat mode 402 or from an already warm 304 gas heater at a temperature above T2 or T1 as described above. A second gas heating rate may be determined 510 with data inputs such as the T3 desired hot water temperature set point value 512 and the T-outlet temperature value 416. Further optional data value inputs for further determining the second gas heating rate 510 may be the second temperature threshold T2 value 514, the flame on signal 422, T-inlet temperature value 424, the valve operating characteristics 314 and the flow rate 420.

Once the second gas heating rate has been determined 510 a second gas heating rate to the heat exchanger may be adjusted 516. Whilst the normal temperature control mode is in operation the determination 510 of second gas heating rate and subsequent adjustment 516 of second gas heating may be continued in order to maintain the hot water temperature substantially as desired, for example approximately to the T3 temperature set point.

It will be readily appreciated that additional control and method steps may be added to FIG. 5 for such safety conditions as when water flow stops or reduces to unsatisfactory flow rates, when there is no flame signal and the like.

Further advantages to those described above are: maximise gas energy efficiency, reduce hot water delivery lag time. Other advantages are: more immediate hot water which heats intervening pipe work at the low fluid flow rate Fm. Overall faster hot water supply to a shower head or a tap than other systems or apparatus. Also, there is a no electricity supply option; that is the gas heater for water is suitable for an independent electrical supply within the gas heater itself.

In this specification, terms denoting direction, such as vertical, up, down, left, right etc. or rotation, should be taken to refer to the directions or rotations relative to the corresponding drawing rather than to absolute directions or rotations unless the context require otherwise.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A gas heater for water comprising:

a gas burner;

a heat exchanger in communication with the gas burner to receive heat therefrom;

a water inlet and a water outlet coupled to the heat exchanger, wherein the water inlet directs water into the heat exchanger and the water outlet directs the water out from the heat exchanger;

a primary water flow path extending from the water inlet to the water outlet through the heat exchanger;

a water control flow restrictor including a constriction and a valve, the constriction disposed in the primary water flow path;

a secondary water flow path that bypasses the constriction and rejoins the primary water flow path after the constriction such that water that flows through the secondary water flow path also flows through the heat exchanger; and a controller in operative communication with the gas burner and the valve, wherein the controller is configured to (a) restrict the water that flows through the secondary water flow path by closing the valve, (b) determine a first rate of heating of the water that flows through the heat exchanger, (c) adjust operation of the gas burner to thereby adjust application of the heat to the heat exchanger, (d) repeat (b)-(c) until the water that flows out from the heat exchanger through the water outlet has a temperature above a temperature threshold, (e) increase the water that flows to the heat exchanger by opening the valve, and (f) thereafter determine a second rate of heating of the water that flows through the heat exchanger.

2. The gas heater as in claim 1, wherein the water valve is in the secondary water flow path and is in fluid communication with the water that flows between the water inlet and the water outlet.

3. The gas heater as in claim 1, wherein the valve is electronically controlled.

4. The gas heater as in claim 1, wherein the first rate of heating of the water that flows through the heat exchanger is determined based upon at least one of a temperature of water at the water outlet, a water flow rate, a flame on signal, a valve operating characteristic, and a temperature of water at the water inlet.

* * * * *